US010366637B2

(12) United States Patent
Rensmo

(10) Patent No.: US 10,366,637 B2
(45) Date of Patent: Jul. 30, 2019

(54) MODULAR ILLUMINATED SIGN, ILLUMINATED PANEL OR ILLUMINATED WALL

(71) Applicant: Anders Rensmo, Orebro (SE)

(72) Inventor: Anders Rensmo, Orebro (SE)

( * ) Notice: Subject to any disclaimer, the term of this patent is extended or adjusted under 35 U.S.C. 154(b) by 0 days.

(21) Appl. No.: 15/558,475

(22) PCT Filed: Mar. 14, 2016

(86) PCT No.: PCT/SE2016/050206
§ 371 (c)(1),
(2) Date: Sep. 14, 2017

(87) PCT Pub. No.: WO2016/148628
PCT Pub. Date: Sep. 22, 2016

(65) Prior Publication Data

US 2018/0068596 A1 Mar. 8, 2018

(30) Foreign Application Priority Data

Mar. 18, 2015 (SE) ..... 1500142

(51) Int. Cl.
*G09F 13/04* (2006.01)
*G09F 13/08* (2006.01)
*G09F 15/00* (2006.01)

(52) U.S. Cl.
CPC ..... *G09F 13/0413* (2013.01); *G09F 13/04* (2013.01); *G09F 13/08* (2013.01); *G09F 15/0068* (2013.01)

(58) Field of Classification Search
CPC ..... G09F 13/0413; G09F 13/04; G09F 13/08; G09F 15/0068
See application file for complete search history.

(56) References Cited

U.S. PATENT DOCUMENTS 3,390,259 A * 6/1968 Angier ..... F21S 8/088 362/812
3,703,779 A * 11/1972 Goldman ..... G09F 13/04 40/564
3,984,931 A * 10/1976 Belokin, Jr. ..... G09F 7/08 40/559

(Continued)

FOREIGN PATENT DOCUMENTS

WO 199916042 A1 9/1998

OTHER PUBLICATIONS

European Patent Office (EPO) Communication and European Search Report for European Patent Application No. 16765343.5, Oct. 12, 2018, 9 pages.

(Continued)

*Primary Examiner* — Gary C Hoge
(74) *Attorney, Agent, or Firm* — The Marbury Law Group, PLLC

(57) ABSTRACT

The invention relates to a modular illuminated sign 1 (or illuminated panel or illuminated wall) that may be assembled in modules, wherein each module 2 comprises a front part 3 and a corresponding rear part 9, braces 10, 60, 130, 140 which keep the front part and the rear part separate at a predetermined distance and, in cases where the module comprises an edge 90 forming the periphery of the sign, a corresponding frame part 60, 65, 130, 140.

12 Claims, 4 Drawing Sheets

(56) References Cited

U.S. PATENT DOCUMENTS 4,074,452 A * 2/1978 Bellinder ..... G09F 13/04 40/571
4,166,332 A * 9/1979 Donovan ..... G09F 19/18 160/135
4,805,783 A * 2/1989 Mayer ..... A47F 5/0846 211/189
5,024,015 A * 6/1991 Quarles, Jr. ..... E04H 1/1272 160/391
5,069,263 A * 12/1991 Edwards ..... A47G 5/00 160/135
5,125,193 A * 6/1992 Beaulieu ..... G09F 15/0068 16/227
5,220,952 A * 6/1993 Beaulieu ..... A47G 1/065 160/135
6,050,013 A * 4/2000 Heaton ..... G09F 13/04 40/570
6,305,455 B1 * 10/2001 Wendel ..... E04B 2/7405 160/135
6,543,164 B1 * 4/2003 Sperl ..... G09F 15/0068 40/605
2002/0104241 A1 * 8/2002 Grate ..... G09F 13/04 40/552
2007/0144990 A1 * 6/2007 Liao ..... G09F 15/0068 211/85.26
2014/0239139 A1 * 8/2014 Opsomer ..... G09F 9/33 248/329
2015/0302783 A1 * 10/2015 Rensmo ..... G09F 15/0012 40/564

OTHER PUBLICATIONS

International Application No. PCT/SE2016/050206, Written Opinion of the International Searching Authority, dated May 25, 2016, 6pgs.

* cited by examiner

MODULAR ILLUMINATED SIGN, ILLUMINATED PANEL OR ILLUMINATED WALL

TECHNICAL AREA OF THE INVENTION

The invention relates to an illuminated sign of the type with a front arranged to be illuminated by a source of backlighting, said illuminated sign is composed of modules. The invention is also applicable in other similar lighting devices, such as illuminated walls or illuminated panels. Typically, such lighting uses light-emitting diodes such as LEDs.

BACKGROUND AND PRIOR ART

Illuminated signs with translucent fronts have many areas of application, such as to display a name or logotype, and exist in many sizes, of which the larger ones may have a front with an area of tens of square meters, e.g. an area within the range of approximately 10-50 $m^2$. To facilitate rational transportation and assembly, these large illuminated sign fronts usually comprise a number of mutually joinable front parts, or alternatively a soft film or cloth that may be fastened around the perimeter inside a frame construction.

Illuminated signs of such larger sizes are exposed to strain in the form of suction or pressure forces caused by the wind, which places great demands on the connection between joinable stiff front parts, or the attachment of the soft film/cloth in the frame construction, respectively.

A prior art solution for mutual connection of joinable parts of an illuminated sign front made of acrylic plastic comprises that the meeting edges of the front parts are folded inwards and recessed in a U-shaped profile, which is anchored in superjacent and subjacent frame parts of a frame construction.

Illuminated signs comprising large fronts made of acrylic plastic are comparatively heavy constructions, so that the front, which is heavy, requires a correspondingly strong frame construction to carry the front. This places demands, in turn, on sturdier mounting devices and a strong carrier on which the illuminated sign is to be fitted.

Accordingly, there is a desire and a need for an illuminated sign of lighter construction that may nevertheless resist the strain of suction and pressure forces to which large signs may be exposed.

SUMMARY OF THE INVENTION

The invention accordingly relates to a modular illuminated sign that may be assembled in modules, where each module comprises a front part and corresponding rear part, and, in cases where the module comprises (an) outer edge(s), (a) corresponding frame part(s).

For a prior art illuminated sign according to the preamble in claim 1, comprising a translucent front 40 for backlighting, a rear part 50, and a frame 100 connecting said front and rear part with each other, wherein the front consists of two or several front parts 3 which in a joined position form the front of the illuminated sign, and wherein each front part has a respective edge 5, 6 adapted to the adjacent front part(s), so that meeting edges form an essentially tight joint 7 between the front parts in their joined position, and which sign comprises braces 10, 60, 130, 140 intended to keep the front and rear part separate from each other at a predetermined distance so that a space is formed between the front and the rear part to facilitate backlighting of the front, this was solved with the features specified in the characterising portion of claim 1, according to which the illuminated sign is composed of two or more modules 2, wherein each module comprises a front part 3, a rear part 9, and braces 10, 60, 130, 140 intended to keep the front part and the rear part separate from each other at a predetermined distance so that a space is formed between the front part and the rear part to facilitate backlighting of the front part, and wherein the rear part 50 of the sign comprises two or several rear parts 9, and the front 40 has locking parts 20; 30 which, by engaging with each other, keep the front parts in a joined position so that they form said translucent front 40, and wherein the edge 90 forming part of the periphery of the sign has a frame part 80, 65, 130, 140 and wherein the front parts are locked in a joined position with the frame parts.

Thanks to this construction of the illuminated sign it is thus possible to build the illuminated sign in the form of modules. The modules facilitate transport. The modular structure also facilitates assembly, especially if the front is made of e.g. acrylic plastic. The modules may also be made very light, e.g. by using self-supporting material, such as e.g. corrugated plastic. The modules may then be assembled one by one on site, to form the intended final illuminated sign. The modules may e.g. be assembled one by one against a wall. When assembled, the locking part is fitted in the next module's front part in the corresponding locking part of the assembled module's front part, following which the subsequent module may be attached to the base, e.g. a wall, against which the sign is assembled.

The illuminated sign may also be independent, e.g. standing on a floor or on the ground.

The front parts may, according to the invention, be fitted in each other so that they are joined. The construction may, by choosing suitable locking parts 20 and 30, be easily dismantlable. Thanks to the innovative construction of the illuminated sign, final locking of the joints will be possible by means of the frame, which restricts the mobility of the front parts both in the plane and straight out of the plane. The frame means it is impossible to disassemble the front parts or the modules from each other.

The locking parts according to the invention also function as a sealing element, resulting in an improved sealing in the joints between the modules.

Illuminated signs according to the invention may be built in only one row vertically or horizontally, or in several rows vertically and/or horizontally. The finished illuminated sign composed of modules may, in principle, have any desired shape, and is therefore not limited to e.g. a square shape, but may have a circular shape or the shape of a letter or character or other graphic figure.

Typically, the edges 5, 6 of a module 2 according to the invention have a dimension between 1-2 m and 1-6 m, respectively.

Thanks to the innovative modular construction, large illuminated signs may be achieved, transported and assembled more easily.

According to one embodiment, the frame parts may also serve as braces. This is achieved with frame parts of the types 80, 130 and 140. Grooves may for example be arranged on the inside of the frame parts, at the top and bottom as in frame part 80, in which grooves the front part and corresponding rear part, respectively, may be fitted, or a rim may be arranged on the inside of the frame parts, against which rim the front part may rest, as in the frame parts 80 and 140. Thus, like the braces 10, the frame part may also function as a brace, which serves to keep the front part and the rear part at a predetermined distance from each other.

According to another preferred embodiment, the braces 10 are arranged in the area next to the joint or joints 7. The strength and rigidity of the finished illuminated sign, as well as of the module with thus arranged braces, are thus improved. The braces 10 may be placed alternately on one of the two modules along the joint 7, partly along the joint on one of the modules or on the other module, or along the entire joint of one of the modules or of the other module, or on both modules in one of the previously mentioned ways.

To reduce weight, the front parts 3 are self-supporting. Self-supporting means that the part is made of a front panel and a rear panel, and that interconnecting transverse walls are distributed over the area of the part connecting the front panel with the rear panel. The transverse walls may be arranged with varying mutual distances, or be regularly and evenly distributed and delimit uniformly shaped cavities between the front and rear panel. These cavities or channels may run in parallel with the panels or extend between the panels. The channels may have any cross-section, and may for example have a tetragonal or cylindrical cross-section. The transverse walls may alternatively have a random shape in a randomised structure with randomly shaped cavities or cells between the front and the rear panel.

The rear part 50 is advantageously also made of a self-supporting material, as are the braces 10 in an even more preferred embodiment. The braces 130 and 140 may also be made of a self-supporting material, but are usually made of stiff foam.

Corrugated plastic is a particularly preferred self-supporting material.

For improved locking of the front parts, and thus also of the modules, with each other, at least one of the locking parts 20; 30 extends in under the meeting edge 5, 6 and preferably both locking parts extend in under the meeting edge 5, 6.

For improved resistance against suction forces the front may advantageously be made concave. In such an embodiment, the braces 10 in the illuminated sign and in the modules are of such a shape and height that the front, when it rests on these and in applicable cases also on the braces 60, 130 and/or 140, has a concave surface.

Suitably, the connecting elements 70, 85, 65 of the modules are arranged to keep the front part 3 joined with the respective rear part 9 through the intermediate braces 10, 60, 130, 140.

In one embodiment, the frame parts constitute both braces and connecting elements. One example of a frame part with such a shape is illustrated in FIG. 2B of frame part 80. As mentioned above, grooves may for example be arranged in the frame parts at the top and bottom, in which grooves the front part and the rear part, respectively, may be fitted. Since the grooves are adapted to minimise the play for the fitting of the front part and the fitting of the rear part therein, a frame part having such grooves will also function as a connecting element.

According to another embodiment the front and rear parts are fitted so that they are floating in relation to each other by means of a resilient connecting element 70. In such an embodiment, the front parts 3 are not fixed in the braces 10, 60, 130, 140, but may move in the plane in relation to the braces. The advantage of this embodiment is that it allows a certain movement in the front, e.g. because of expansion/contraction due to temperature changes, e.g. heat when the front is exposed to sunlight, for example. The frame parts and potential grooves in these, in which the front may be fitted, are thus adapted to allow a corresponding movement in the front. The mobility should then be consistent with the temperature expansion coefficient and may e.g. be within the interval 0.1-1% of the length and height of the front. Springs, wires, such as piano wire and spring wire, rubber straps, rubber bands etc. may be used as the resilient connecting element 70. The wire may e.g. be bent suitably to allow resilience.

In one preferred embodiment, the connecting elements 70 are arranged in the area next to one or several joints 7. Through the arrangement next to the joints, the strength of the modules and the sign is improved.

In another preferred embodiment, one of two adjacent front parts 3 next to a joint 7 has an upper surface, extending past the joint 7 to dovetail with the opposite adjacent edge 5, 6 of the second adjacent front part 3, for example as illustrated in FIG. 2A. Thus, an essentially improved sealing of the joint 7 is achieved, at the same time as the connection of the modules and thus also the strength of the illuminated sign are improved. In one embodiment with self-supporting front parts, suitably the upper panel of the front part in one module extends over the joint 7, so that this overlaps a section of an adjacent front part. An overlap also improves the visual impression of the areas with joints 7. In illuminated signs with horizontal joints 7 between adjacent edges 6, the bottom edge 6 of the upper module's front part suitably has an overlapping area extending some way over the corresponding top edge 6 of the lower module's front part. Thus, water and dirt is efficiently led away from the horizontal joint 7.

In one preferred embodiment, the locking parts 20; 30 are locked in a disconnectable way by hooking into each other. Thus, a module may be lifted on site and the locking part on the front part may be hooked into the corresponding locking part on the already fitted module, wherein the latter keeps the recently fitted module in place and connected with the already fitted module. In the meantime, the recently fitted module may be easily attached to the wall or other underlying surface, e.g. via attachment through a hole 120 in a protruding part of a hat profile 110, arranged at the free end of the recently suspended module, as illustrated in FIG. 4.

In one preferred embodiment, the attaching element, e.g. a hat profile 110, forms, jointly with the attachment, e.g. an L-profile, a space for the brace 10 in which the adjacent rear part of the adjacent module may be fitted. Thus, the durability of the sign and the sealing in the rear part of the sign are improved. This is illustrated in FIG. 2A.

The locking parts are suitably made of a translucent plastic material, specifically transparent polycarbonate plastic. This means the joints are less visible, which improves the visual impression of the sign. The front 40 may be equipped with a diffraction film on surfaces where the locking parts are not attached, in order to further improve the impression of the sign and to minimise the visibility of the front part joints.

Frame parts 80, 65, 130, 140 on the modules preferably extend up to the joint 7 and are thus flush with the edge of the front part.

In all other essential respects, the frame 100 may be designed as described in WO2012/015352 and may also be locked in a joined position as described therein.

The invention allows for a novel way of assembling an illuminated sign. Accordingly, the invention relates to a method of assembling an illuminated sign 1 comprising front 2, rear part 50 and braces 10, 60, 130, 140, intended to keep the front and rear part separate from each other at a predetermined distance, so that a space is formed between the front and rear parts for backlighting of the front, wherein the sign is assembled on site in two or more modules 2, wherein each module comprises a front part 3, a rear part 9 and braces 10, 60, 130, 140, intended to keep the front and rear part separate from each other at a predetermined distance, so that a space is formed between the front and rear parts for backlighting of the front, wherein a first module 2 first is placed in the desired place, following which a second adjacent module 2 is fitted into the first module to engage with this, and following which, in applicable cases, the remaining modules, one after another, are similarly joined together with the module assembled in the previous stage until all modules have been joined.

Even if the invention is described herein with reference to illuminated signs it is easily realised that the invention may also be used for other, similar lighting purposes, such as e.g. illuminated panels and illuminated walls. The term "illuminated sign" as used in this description and in the claims is therefore intended to comprise the terms "illuminated panel" and "illuminated wall".

Additional advantages and embodiments are set out in the detailed description below and in the enclosed claims.

BRIEF DESCRIPTION OF DRAWINGS

Example embodiments of the invention are described below with reference to the enclosed schematic drawings.

DETAILED DESCRIPTION OF THE INVENTION AND PREFERRED EMBODIMENTS

The description below of example embodiments focuses on those aspects of the illuminated sign, which are the subject of the patent application. Details normally occurring in illuminated signs, which are of subordinate importance for understanding the invention, such as electric and electronic equipment, suspension devices and the structure of the colour and image layer on the front of the illuminated panel, will not be dealt with in this description. By way of introduction, it should also be mentioned that references to spatial relationships and orientations in the description are intended as a support to facilitate reading of the drawings and should not be understood as limitations of the invention.

Figure 2A:
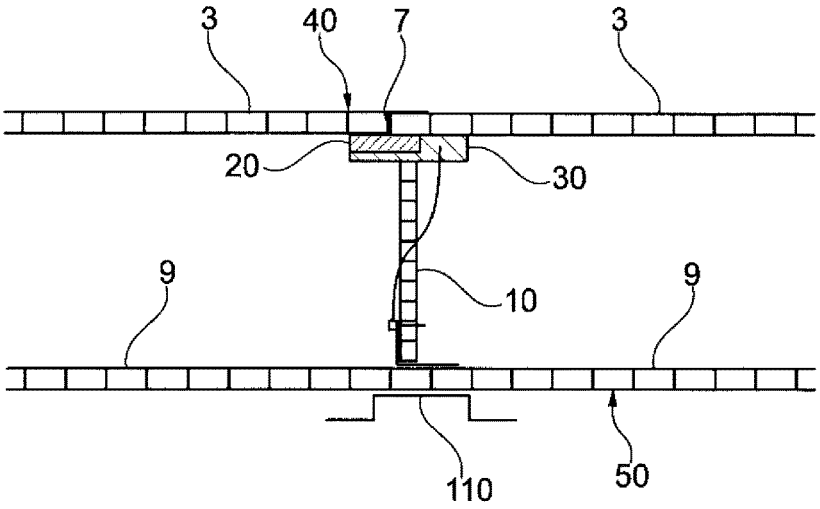
FIG. 2A shows a cross-section IIA from FIG. 1 seen from above, through two joined modules 2 whose front parts 3 with their respective edges 5 meet each other in the vertical joint 7, and where there is an overlap over the joint 7. In the figure, the front part 3, the rear part 9 and the brace 10 are made of corrugated plastic. A hat profile 110 is arranged in one of the front parts 3, in a hole 120 through which the hat profile may be attached to the underlying surface, e.g. a wall.
Figure 3:
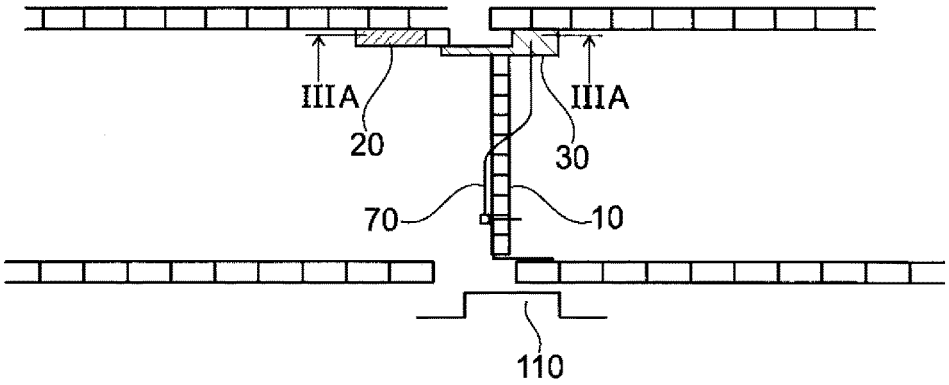
FIG. 3 shows a cross-section corresponding to the one in FIG. 2A, where the modules are in the vicinity of each other, but not joined.
Figure 3A:
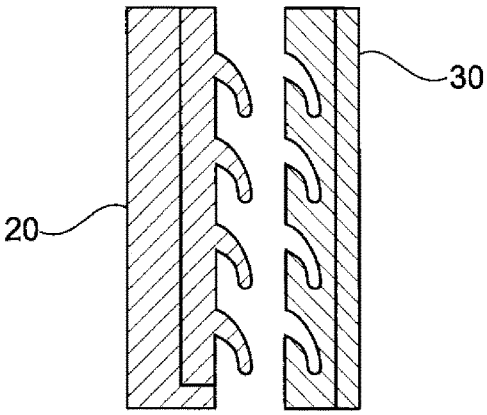
FIG. 3A shows a cross-section IIIA from FIG. 3 through locking parts 20 and 30, which are separate in a non-joined position.
Figure 2B:
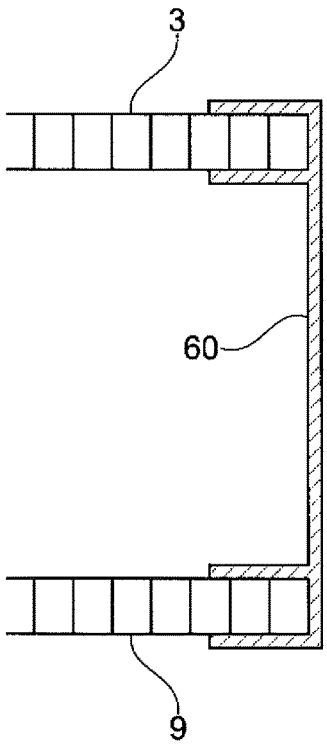
FIG. 2B shows a cross-section IIB from FIG. 1 through the frame part 80, where a rim on which the front part 3 rests forms a brace, and where grooves are arranged in which the front part 3 and the rear part 9, respectively, are fitted with a minimal vertical play, the frame part 80 thus simultaneously constituting a clamping element. In the figure, the front part 3 and rear part 9 are made of corrugated plastic.
Figure 4:
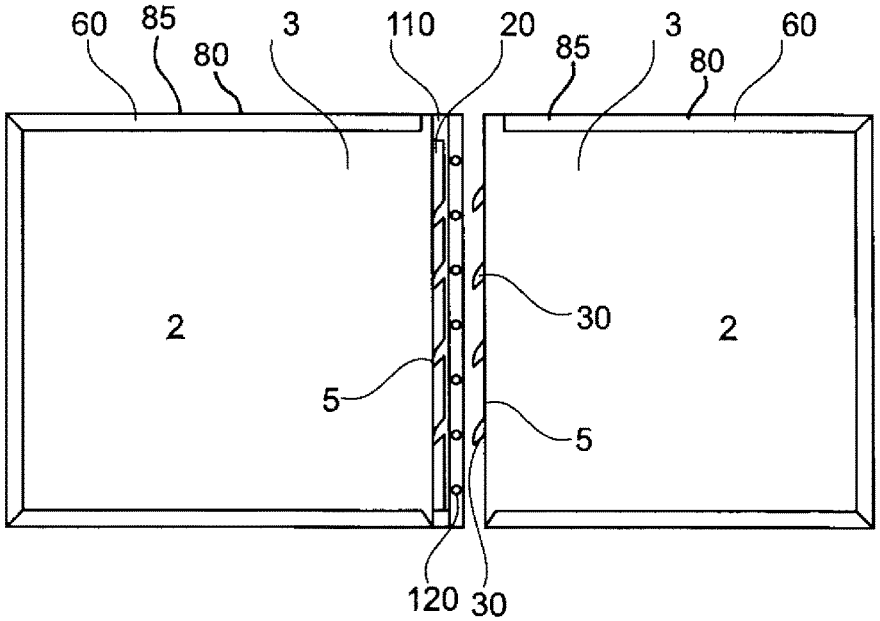
FIG. 4 shows two modules 2 from above, similar to the ones displayed in FIGS. 2A and 3, disassembled, which modules, together, form an illuminated sign 1. In order to optimise the visibility of the joint 7 with locking parts 20 and 30, there is no overlap between the front parts 3. In this embodiment the locking parts 20 and 30 extend under the meeting edge 5 of the adjacent front part 3. For purposes of illustrating the edges 90, the frame parts 80 do not extend all the way up to the joints 7, which they would otherwise typically do in a more preferred embodiment.
Figure 5:
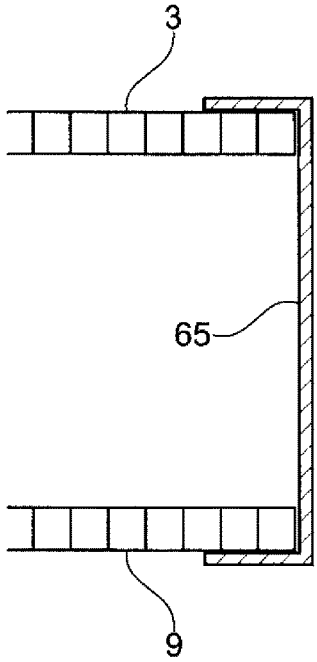
FIG. 5 shows a cross-section corresponding to the one in FIG. 2B with an alternative frame part 65, adapted as a U-profile, which thus simultaneously constitutes a clamping element. In the figure, the front part 3 and rear part 9 are made of corrugated plastic.
Figure 6A:
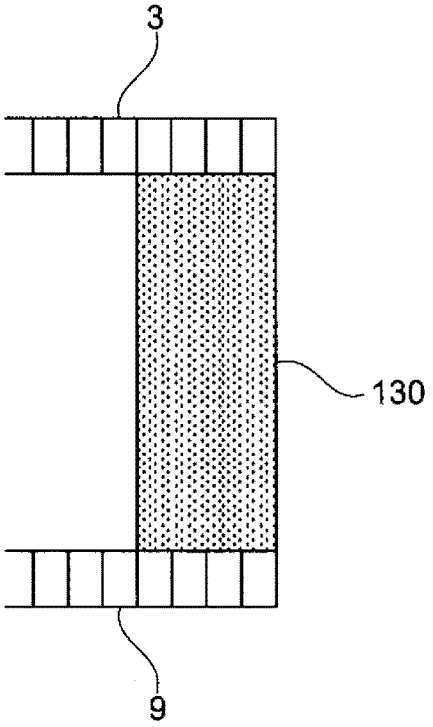
FIG. 6A shows a frame part 130 made of stiff foam. The frame part in this embodiment also functions as a brace. The frame part and the edge of the front part 3 and the rear part 9, respectively, are covered with a thin film or alternatively completed with a frame part 65 for aesthetic reasons.
Figure 6B:
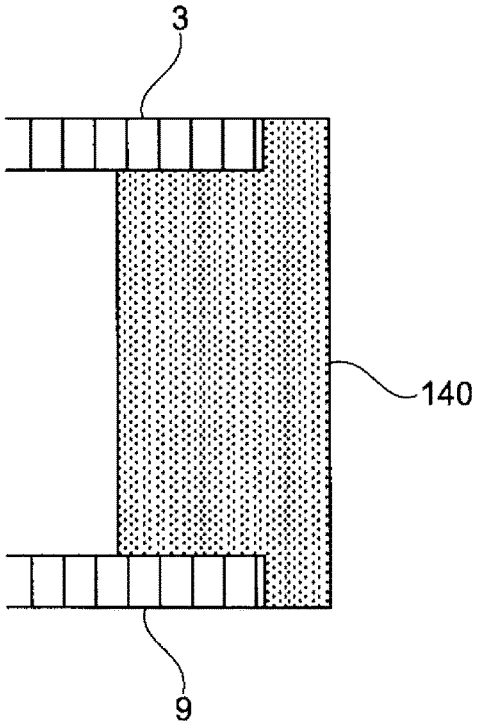
FIG. 6B shows an alternative frame part 140 made of stiff foam, where the front part 3 and the rear part 9 rest in recesses in the frame part 140, and where the frame part may form a uniform exterior of the sign. The frame part in this embodiment also functions as a brace. Frame part 140 may be completed with a frame part 65.

By way of a suitable embodiment of the locking parts 20 and 30, which e.g. hook onto the part 20 and the corresponding recess in the part 30, as displayed in FIG. 2-4, the modules may be easily hooked into and from each other. The sign may thus also be easily disassembled. Other embodiments of the locking parts, allowing for fitting of one part into the other, e.g. by hooking, will be obvious to the person skilled in the art.

Installation suitably begins from right to left or from left to right, depending on the design of the locking parts. The sign in two modules as displayed in FIG. 4 is suitably installed from left to right, i.e. the left module is installed first, into which the right module may then be fitted. The sign displayed in FIG. 1-3 is also installed from left to right.

Figure 1:
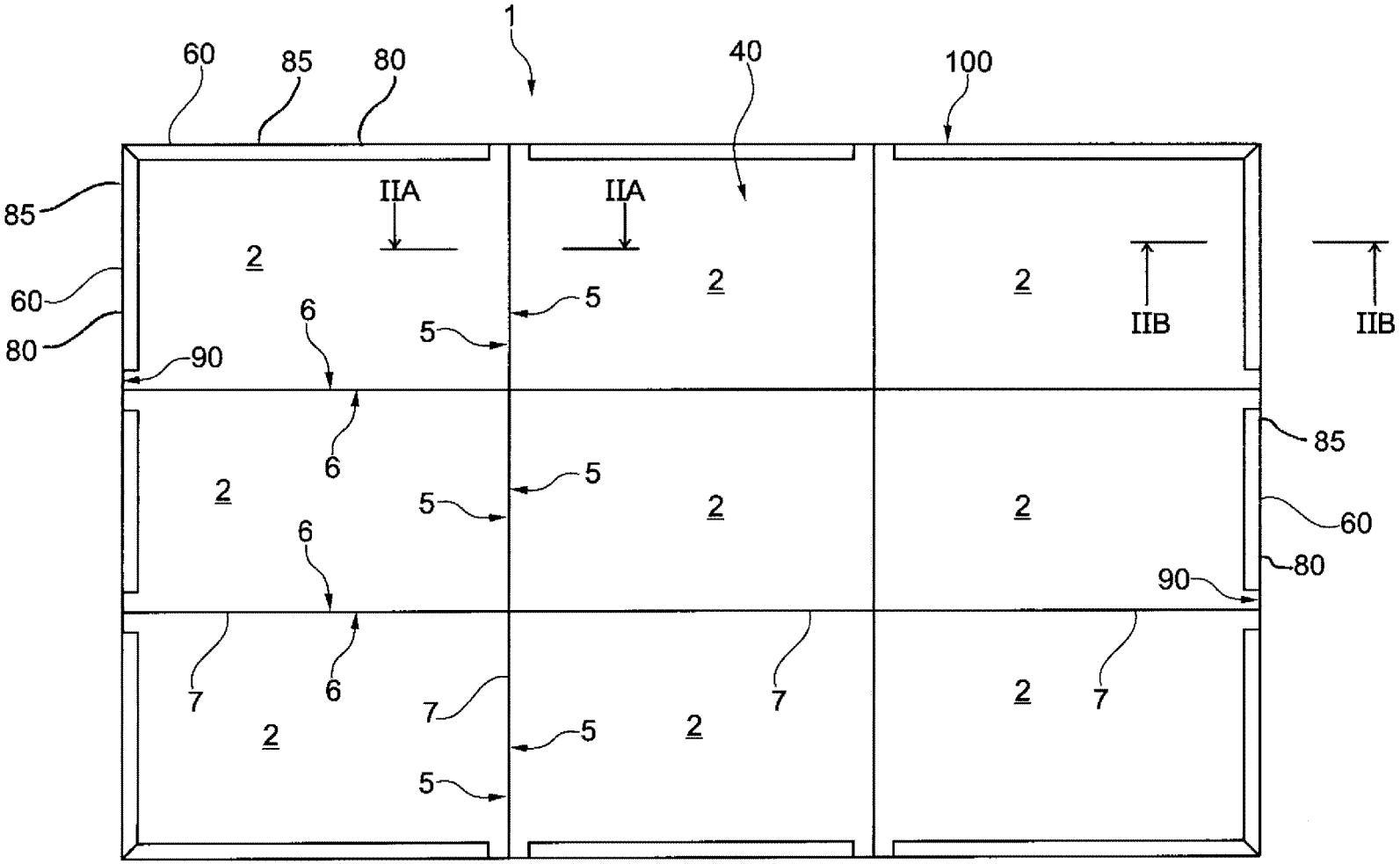
FIG. 1 shows an illuminated sign 1 seen from the front composed of 9 modules 2, where the edges 6 run in the horizontal direction of the sign, and the edges 5 run in the vertical direction of the sign. For purposes of illustrating the edges 90, the frame parts 80 do not extend all the way up to the joints 7, which they would otherwise typically do in a more preferred embodiment.

If the sign consists of two or more horizontal rows, as in FIG. 1, the modules are suitably built from the bottom and upwards, so that the nearest superjacent module with its bottom edge 6 may rest on the underlying module's top edge 6. The locking in horizontal joints or essentially horizontal joints may e.g. occur with the use of gravity and elements fitting into each other and engaging. For example, the locking parts may be adapted as tongue and groove, pin or pins and corresponding holes, a groove and a corresponding protruding profile fitting into the groove.

The locking parts 20 and 30 may also be adapted for so-called click locking, similar to the type of locking in e.g. click-lock flooring.

According to the invention, locking occurs between all front parts in each joint 7 between all meeting edges.

The rear part 50 typically has an essentially corresponding shape to the front part 3 of the respective module. In a case where the front part has an overlapping top surface, the rear part does not need to have a corresponding overlap.

In a case where the rear part 9 and the front 2 have essentially the same dimensions in terms of length and width, the rear part may also be divided in a somewhat different manner than the front.

In some cases, the rear part and the front may have somewhat different dimensions in terms of length and width, e.g. for one of these to fit into a groove in the frame parts, or because the frame is leaning inwards or outwards.

Front and rear parts may also be somewhat twisted in relation to each other, e.g. to achieve a desired graphic and/or spatial effect.

Furthermore, the front and rear parts may be somewhat offset in relation to each other in some direction. The same applies to the front part 3 and the rear part 50 in a module.

When a frame part 65 is used, the brace 10 is suitably arranged in the edge 90 inside the frame part 80. Such a brace 10 may advantageously be made of stiff foam, and its placement and embodiment may coincide with a frame part 130.

The frame 100 is suitably adapted so that it acts sealingly along the periphery of the sign. The frame may e.g. essentially consist of frame parts 80, 65, 130, 140, jointly with potential splicing connections and/or seals between these.

The frame part 130 or 140 may suitably be attached in the front part and rear part with a glued connection, or double-sided adhesive tape.

Locking of the front parts in an assembled position with use of the frame parts may for example be by way of joints connecting the frame parts and keeping these together, e.g. a glued, riveted or bolted connection. The connections may be located next to the joints between the frame parts, and extend over these some way on either side, or the joints may run jointly around the whole periphery of the sign. The joints are suitably adapted to the frame parts. For frame parts of type 130 and 140, the joints may e.g. have a U-profile to contribute to the connection of front and rear parts. Together with the joints, the frame parts form the frame 100.

The locking parts 20 and 30 may suitably be attached in the front parts with glued connections.

The brace 10 may be used in more centrally located areas in a module to provide further stability to the module and the front part.

The connecting elements 70 may, at the rear, be attached to the rear part, or to an attachment for the brace 10, e.g. with a screw through an L-profile, as illustrated in FIGS. 2A and 3, and at the front they may be attached in the front part 3 or in the locking part of the same module, as illustrated in FIGS. 2A and 3.

A module 2 according to the invention has braces 10, 60, 130, 140 arranged so that they fill the above stated function for a brace. Braces may e.g. be arranged along two sides 5, 6, 90 of the front part, along all sides or only more centrally between the front part and the rear part.

In some embodiments, for example in an illuminated sign composed of modules in a row, it may be advantageous for every second module to be arranged so that the front of said module only has frame parts 65 as a connecting element, and the front thus only resting on potential braces in the module, without being attached to the same. Thus, every second front part will be easy to loosen by disassembly of the corresponding frame parts 65, and subsequent loosening of the locking parts' engagement from the locking parts of the two adjacent modules. Thus, access for service, repairs and maintenance is facilitated, without the modules first having to be disassembled in the reverse order until the desired module is reached. The braces 10 may also e.g. be arranged with spaces along the joints 7, to allow access some way into the adjacent modules.

The invention claimed is:

1. Modular illuminated sign comprising a translucent front portion for backlighting, a rear portion, and a frame connecting said translucent front portion and rear portion with each other, wherein the translucent front portion consists of two or more front parts which in a joined position form the translucent front of the illuminated sign, and wherein each front part has respective horizontal and vertical edges, adapted to abut adjacent front part(s) so that meeting edges form an essentially tight joint between the front parts in their joined position, and which sign comprises braces intended to keep the front and rear parts separate from each other at a predetermined distance, so that a space is formed between the front and rear parts for backlighting of the front portion, characterised in that the sign is composed of two or more modules, wherein each module comprises one front part, one rear part, and braces intended to keep the front and rear parts separate from each other at a predetermined distance, so that a space is formed between the front and rear parts for backlighting of the translucent front portion, in that the rear part comprises two or more rear parts in that the translucent front portion has locking parts, which by engaging with each other keep the front parts together in a joined position, so that these form said translucent front portion, in that a peripheral edge, which forms part of the periphery of the sign, has a frame part and in that the front parts are locked in a joined position with the frame parts; and wherein an upper surface of one of the two meeting edges next to a joint extends past the joint and dovetails with the other meeting edge.

2. The modular illuminated sign according to claim 1, wherein braces are arranged in the area next to one or several joints.

3. The modular illuminated sign according to claim 1, wherein the front parts are self-supporting.

4. The modular illuminated sign according to claim 1, wherein at least one of the locking parts extends under the meeting edge.

5. The modular illuminated sign according to claim 1, wherein the braces are of such height that the front, when it rests on the braces, has a concave surface.

6. The modular illuminated sign according to claim 1, wherein the connecting elements are arranged to hold the front part against the respective rear part via intermediate braces.

7. The modular illuminated sign according to claim 1, wherein the front and rear parts are arranged to be floating in relation to each other with the use of resilient connecting elements.

8. The modular illuminated sign according to claim 1, wherein the connecting elements are arranged in the area next to one or several joints.

9. The modular illuminated sign according to claim 1, wherein locking between locking parts may be disassembled by way of the parts hooking into each other.

10. The modular illuminated sign according to claim 1, wherein the front parts are made of corrugated plastic.

11. The modular illuminated sign according to claim 1, wherein the locking parts are made of a translucent plastic material, specifically transparent polycarbonate plastic.

12. A method of assembling an illuminated sign comprising a front portion, a rear portion and braces intended to keep the front and the rear portions separated from each other at a predetermined distance, so that a space is formed between the front and rear portions for backlighting of the front, the method comprising assembling two or more modules on site, wherein each module comprises a front part, a rear part and braces intended to keep the front and the rear part separated from each other at a predetermined distance, so that a space is formed between the front and rear parts for backlighting of the front, wherein a first module is first placed in a desired place, following which a second adjacent module is fitted into the first module to a joining engagement with the latter, and following which, when more than two modules are provided, the remaining modules, one after the other, in a similar manner are joined with the modules joined in previous stages, until all the modules have been joined together; and wherein the modules comprise edges and the edges of adjacent modules meet next to a joint such that an upper surface of at least one of the edges extends past the joint and dovetails with the other edge.

* * * * *